US008985722B2

(12) United States Patent
Shindo

(10) Patent No.: US 8,985,722 B2
(45) Date of Patent: Mar. 24, 2015

(54) PRINTING APPARATUS

(75) Inventor: Tatsuya Shindo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 647 days.

(21) Appl. No.: 12/712,848

(22) Filed: Feb. 25, 2010

(65) Prior Publication Data

US 2010/0220137 A1 Sep. 2, 2010

(30) Foreign Application Priority Data

Feb. 27, 2009 (JP) ..... 2009-045112

(51) Int. Cl.
*B41J 29/38* (2006.01)
*B41J 2/045* (2006.01)

(52) U.S. Cl.
CPC ..... *B41J 2/04595* (2013.01); *B41J 2/04551* (2013.01); *B41J 2/0458* (2013.01); *B41J 2/04581* (2013.01); *B41J 2/04588* (2013.01); *B41J 2/04593* (2013.01)
USPC ..... 347/14; 347/7

(58) Field of Classification Search
USPC ..... 347/7, 14
See application file for complete search history.

(56) References Cited

U.S. PATENT DOCUMENTS

| | | | | |
|---|---|---|---|---|
| 5,663,750 | A * | 9/1997 | Sakuma | 347/7 |
| 6,286,923 | B1 | 9/2001 | Sugahara | |
| 7,567,357 | B2 * | 7/2009 | Kato et al. | 358/1.14 |
| 2002/0018083 | A1 | 2/2002 | Sayama | |
| 2006/0197786 | A1 | 9/2006 | Yokozawa | |
| 2007/0115507 | A1 | 5/2007 | Vladislav et al. | |
| 2010/0220137 | A1 | 9/2010 | Shindo | |

FOREIGN PATENT DOCUMENTS

| | | | | |
|---|---|---|---|---|
| JP | 11-994 | | 1/1999 | |
| JP | 2001-138498 | | 5/2001 | |
| JP | 2001138498 | * | 5/2001 | B41J 2/01 |
| JP | 2002-103619 | | 4/2002 | |
| JP | 2003-159788 | | 6/2003 | |
| JP | 2004090524 | | 3/2004 | |
| JP | 2004-195912 | | 7/2004 | |
| JP | 2004-223895 | | 8/2004 | |
| JP | 2005022420 | | 1/2005 | |
| JP | 2005-161817 | | 6/2005 | |
| JP | 2006-240269 | | 9/2006 | |
| JP | 2007-145019 | | 6/2007 | |
| JP | 2009006550 | | 1/2009 | |
| JP | 2010194985 | | 9/2010 | |

* cited by examiner

*Primary Examiner* — Uyen Chau N Le
*Assistant Examiner* — Chad Smith
(74) *Attorney, Agent, or Firm* — Frommer Lawrence & Haug LLP

(57) ABSTRACT

A printing apparatus includes: a liquid discharge head which includes a nozzle which discharges a liquid, and a discharge energy applying section which applies a discharge energy to the liquid to be discharged from the nozzle; a drive section which drives the discharge energy applying section; and a controller which controls the drive section based on a parameter about a usage amount of the discharge energy applying section; and when one dot is formed on a printing medium by discharging the liquid, if a predetermined threshold value is not exceeded by the parameter, the controller controls the drive section to drive the discharge energy applying section so that a first discharge energy is applied to the liquid, and otherwise, the controller controls the drive section to drive the discharge energy applying section so that a second discharge energy lower than the first discharge energy is applied to the liquid.

11 Claims, 12 Drawing Sheets

PRINTING APPARATUS

CROSS REFERENCE TO RELATED APPLICATION

The present application claims priority from Japanese Paten Application No. 2009-045112, filed on Feb. 27, 2009, the disclosure of which is incorporated herein by reference in its entirety.

BACKGROUND OF THE INVENTION

1. Field of the Invention

The present invention relates to a printing apparatus which carries out printing on a printing medium by discharging a liquid from a nozzle.

2. Description of the Related Art

In an ink-jet printer described in Japanese Patent Application Laid-Open No. 2009-06550 as a printing apparatus which carries out printing by discharging a liquid from a liquid discharge head, an ink-jet head includes: a flow passage unit in which a plurality of nozzles and an ink flow passage including a plurality of pressure chambers communicating with the nozzles are formed; and a piezoelectric actuator arranged on the upper surface of the flow passage unit to apply a pressure to an ink inside the pressure chambers. The piezoelectric actuator has three piezoelectric layers which are stacked on the upper surface of the flow passage unit, and common electrodes and individual electrodes which are formed respectively on the lower surface and upper surface of the uppermost piezoelectric layer so as to sandwich the uppermost piezoelectric layer on the portions facing the plurality of pressure chambers. Further, the ink-jet head is a so-called line head which extends across a full length of a recording paper in its width direction and is fixed to the ink-jet printer.

Then, when a drive pulse is applied to an individual electrode to generate a potential difference between the individual electrode and a common electrode which is maintained at the ground potential, in the same direction as the direction of polarization of the piezoelectric layer, a downward electric field is generated in the portion of the piezoelectric layer sandwiched by those electrodes. This electric field causes the uppermost piezoelectric layer to contract in a horizontal direction, thereby deforming the three piezoelectric layers at the portions (a piezoelectric element) facing a pressure chamber, as a whole, to project toward the pressure chamber side. Thus, a pressure is applied to the ink inside the pressure chamber.

Here, in the ink-jet head described in Japanese Patent Application Laid-Open No. 2009-06550, as a total number of times of driving a piezoelectric element increases, the polarization of the piezoelectric layer weakens, etc., thereby degrading the drive performance of the piezoelectric element. Therefore, when a drive pulse of a certain height (drive potential) is applied to drive a piezoelectric element, the maximum drivable number of times is predetermined for the piezoelectric element. Thus, if a particular piezoelectric element has a high usage frequency, and the total number of times of driving the piezoelectric element with the high usage frequency will reach the maximum drivable number of times described above, the life of the piezoelectric element ends at an early stage. In this case, even if the other piezoelectric elements are still drivable, the ink-jet head will have to come to the end of its life.

At this time, if the ink-jet head is a so-called serial head which discharges ink while moving in a scanning direction and therefore differs from that described in Japanese Patent Application Laid-Open No. 2009-06550, it is possible to prolong the ink-jet head life by, for example, discharging the ink from another nozzle to the position to which the nozzle corresponding to the expired piezoelectric element should have discharged the ink on the recording paper. However, it is difficult for a line head as described in Japanese Patent Application Laid-Open No. 2009-06550 to carry out such kind of process.

SUMMARY OF THE INVENTION

Accordingly, an object of the present invention is to provide a printing apparatus which has a long-life liquid discharge head.

According to a first aspect of the present invention, there is provided a printing apparatus which performs printing by discharging a liquid onto a printing medium, the printing apparatus including: a liquid discharge head which includes a nozzle which discharges the liquid to the printing medium, and a discharge energy applying section which applies a discharge energy to the liquid to be discharged from the nozzle; a drive section which drives the discharge energy applying section; and a controller which controls the drive section based on a parameter with respect to a usage amount of the discharge energy applying section; and when one dot is formed on the printing medium by discharging the liquid from the nozzle, if a predetermined threshold value is not exceeded by the parameter, the controller controls the drive section to drive the discharge energy applying section so that a first discharge energy is applied to the liquid, and if the predetermined threshold value is exceeded by the parameter, the controller controls the drive section to drive the discharge energy applying section so that a second discharge energy which is lower than the first discharge energy is applied to the liquid.

The discharge energy applying section gets more degraded as its usage amount increases and the total amount of a discharge energy applied to the liquid becomes greater. According to the first aspect of the present invention, when one dot is formed on the recording medium by discharging the liquid from the nozzle which corresponds to the discharge energy applying portion, if a predetermined threshold value is exceeded by a parameter with respect to the usage amount of the discharge energy applying section, the discharge energy which is applied to the liquid from the discharge energy applying section is defined as a second discharge energy which is lower than a first discharge energy, which is applied when the predetermined threshold value is not exceeded by the parameter. Accordingly, it is possible to prolong the life of the discharge energy applying section.

DESCRIPTION OF THE PREFERRED EMBODIMENT

Hereinafter, a preferred embodiment of the present teaching will be described.

Figure 1:
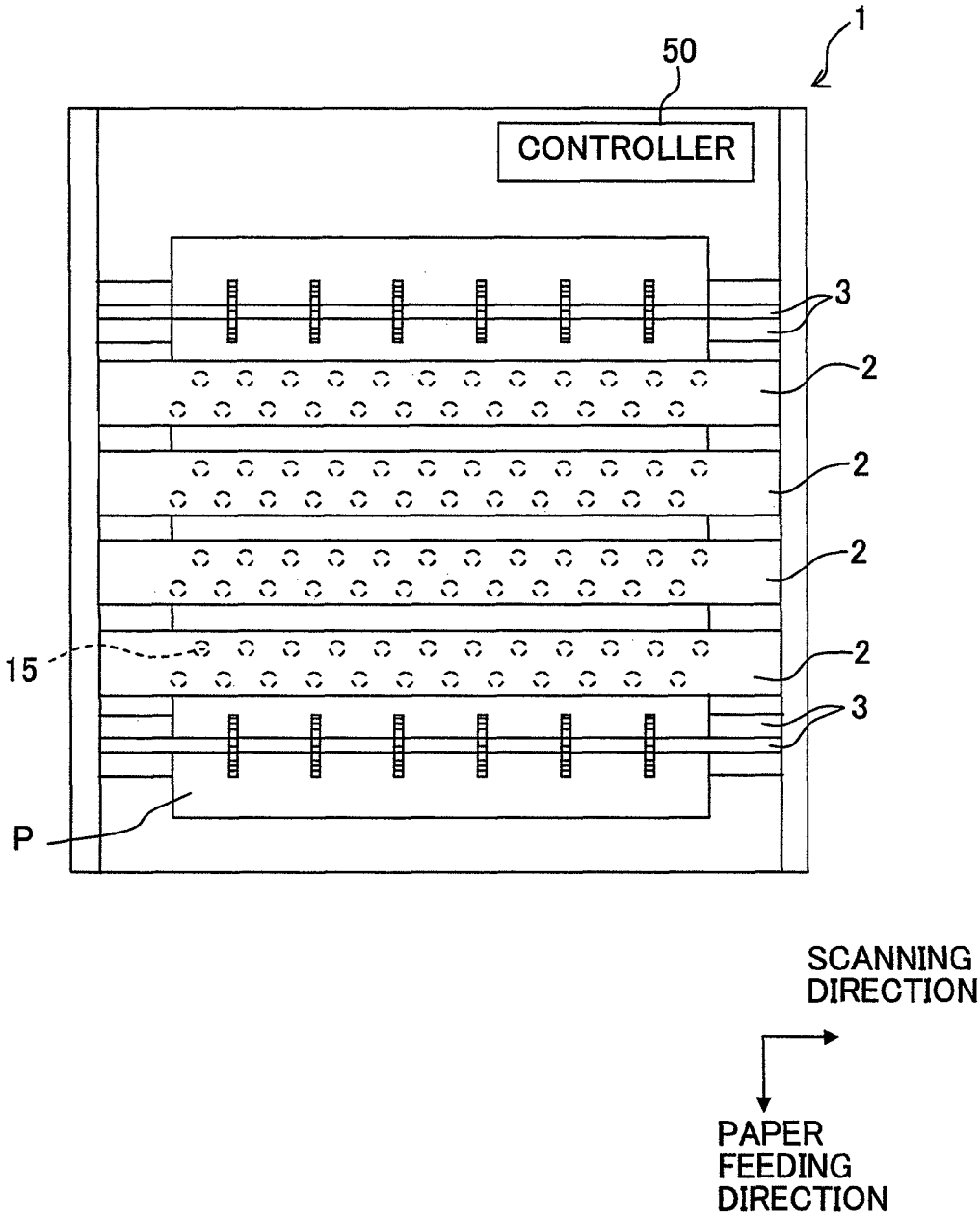
FIG. 1 is a schematic construction diagram of a printer according to an embodiment of the present invention.

As shown in FIG. 1, a printer 1 includes four ink-jet heads 2, transport rollers 3, etc. Further, the printer 1 operates under the control of a controller 50.

The four ink-jet heads 2 as liquid discharge heads are so-called line heads which extend across a full length or width of a recording paper P as a printing medium in a left-right direction (scanning direction) of FIG. 1, and which are fixed to the printer 1, respectively. These four ink jet heads 2 discharge inks of black, yellow, cyan, and magenta, respectively, from a plurality of nozzles 15 formed on the under surfaces of the ink-jet heads 2, in the order of arrangement of the ink-jet heads 2 from the uppermost down to the lowermost in FIG. 1.

The transport rollers 3 are arranged above and below the four ink-jet heads 2 in FIG. 1 such that the four ink-jet heads 2 are located therebetween, to transport the recording paper P toward a lower portion of FIG. 1 (in a paper feeding direction).

Then, the printer 1 carries out printing on the recording paper P by discharging the inks from the nozzles 15 of the four ink-jet heads 2 onto the recording paper P transported by the transport rollers 3 in the paper feeding direction.

Figure 2:
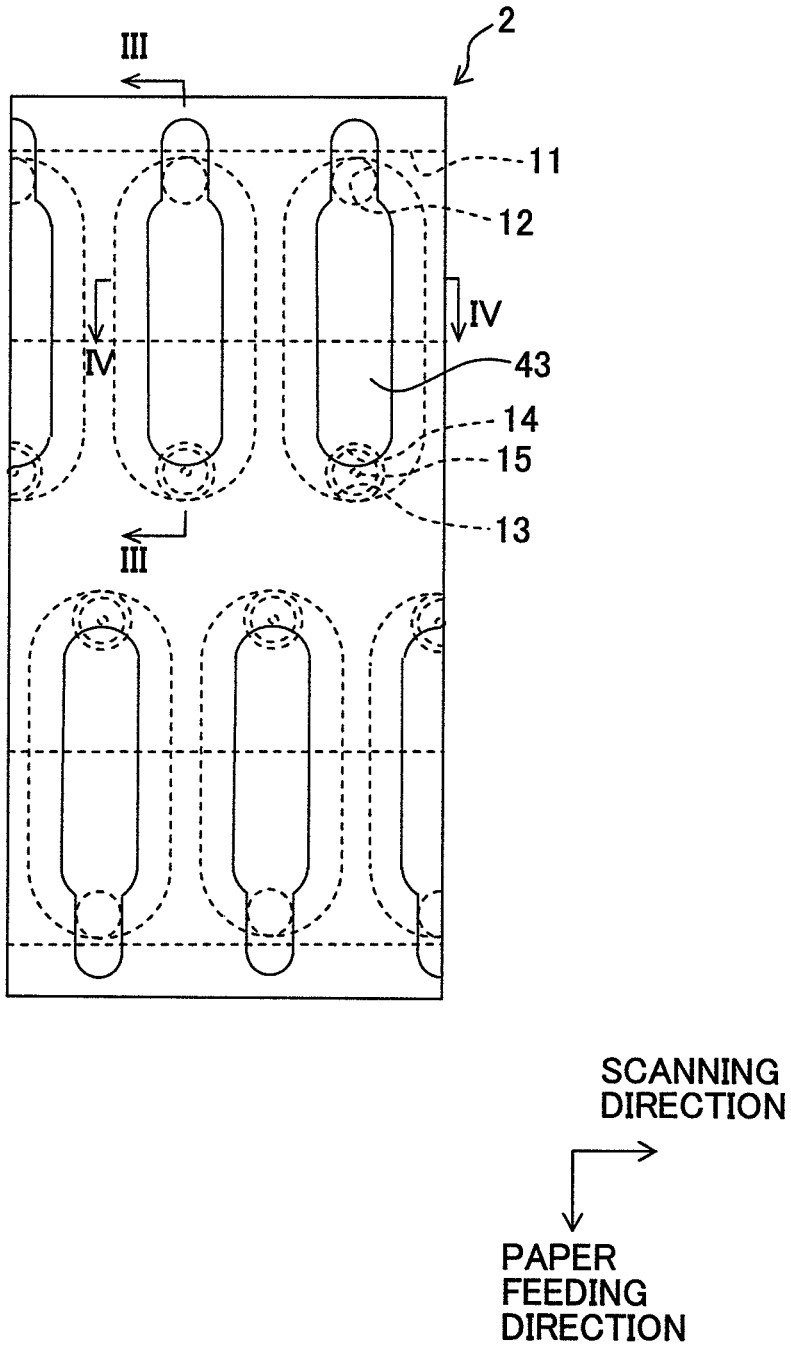
FIG. 2 is a plan view showing a part of an ink-jet head of FIG. 1.
Figure 3:
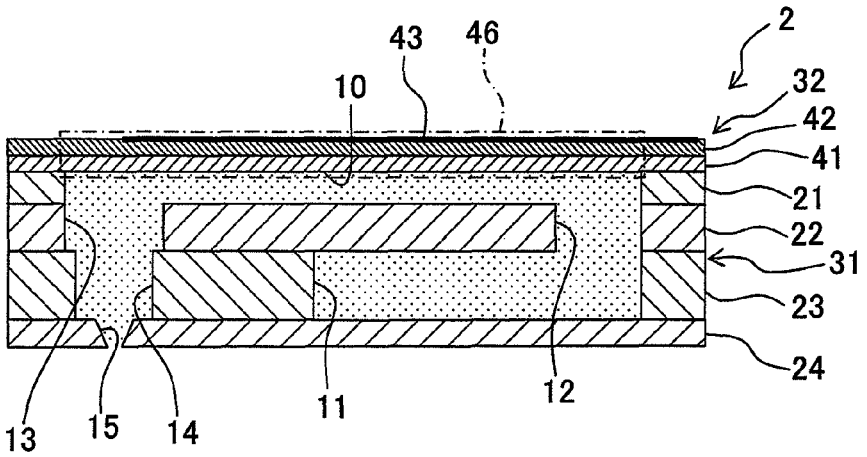
FIG. 3 is a cross-sectional view taken along the line of FIG. 2.
Figure 4:
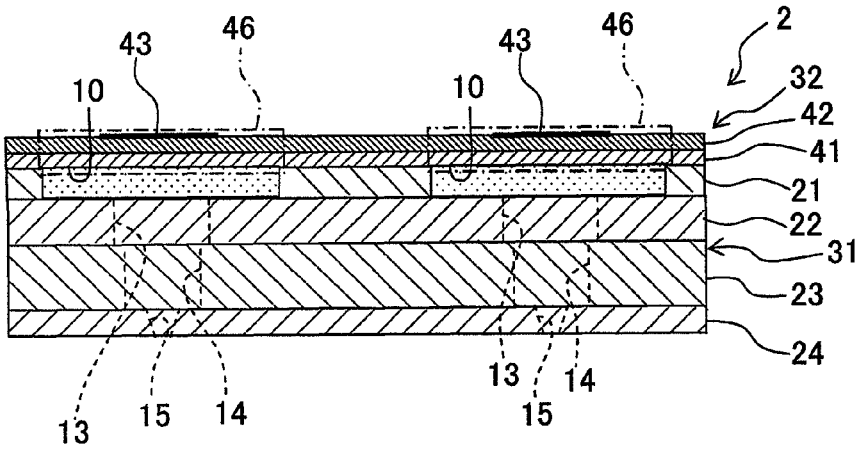
FIG. 4 is a cross-sectional view taken along the line IV-IV of FIG. 2.

Next, an ink-jet heads 2 will be explained. As shown in FIGS. 2 to 4, the ink-jet head 2 has a flow passage unit 31 and a piezoelectric actuator 32.

The flow passage unit 31 is formed by stacking a cavity plate 21, a base plate 22, a manifold plate 23, and a nozzle plate 24 each other. Among these four plates 21 to 24, except for the nozzle plate 24, the plates 21 to 23 are all formed of a metallic material such as stainless steels, etc. while the nozzle plate 24 is formed of a synthetic resin material such as polyimide, etc. Alternatively, the nozzle plate 24 may also be formed of a metallic material like the other plates 21 to 23.

A plurality of pressure chambers 10 are formed in the cavity plate 21. The plurality of pressure chambers 10, each of which has a planar shape of an approximate ellipse with its longitudinal direction in the paper feeding direction (the up-down direction of FIG. 2), are aligned in two rows in the scanning direction (the left-right direction of FIG. 2). A plurality of through holes 12 and 13 are formed in the base plate 22. Each of the through holes 12 and 13 has a shape of an approximate circle in a plane view, and is located in a portion facing either one end portion or the other end portion of a pressure chamber 10 in their longitudinal direction in a plane view.

A manifold flow passage 11 is formed in the manifold plate 23. The manifold flow passage 11 extends in the scanning direction so as to face both the approximately upper half of the plurality of pressure chambers 10 which are aligned on the upper part of FIG. 2 and the approximately lower half of the plurality of pressure chambers 10 which are aligned on the lower part of FIG. 2. Further, in the manifold plate 23, a plurality of though holes 14, each of which has a planar shape of a approximate circle, are formed at the positions facing the plurality of though holes 13 in a plane view.

A plurality of nozzles 15 are formed in the nozzle plate 24 at positions facing the plurality of through holes 14 in a plane view. Further, in the flow passage unit 31, the manifold flow passage 11 communicates with the pressure chambers 10 via the through holes 12, and the pressure chambers 10 communicate with the nozzles 15 via the through holes 13 and 14. In such a manner, in the flow passage unit 31, a plurality of individual ink flow passages are formed from the exits of the manifold flow passage 11 through the pressure chambers 10 to the nozzles 15.

The piezoelectric actuator 32 includes a vibration plate 41, a piezoelectric layer 42 and a plurality of individual electrodes 43. The vibration plate 41 is formed of a metallic material such as stainless steels, etc., and joined to the upper surface of the flow passage unit 31 so as to cover up the openings of the plurality of chambers 10 on the upper surface of the flow passage unit 31. Further, the conductive vibration plate 41 also acts as a common electrode which is constantly maintained at the ground potential for generating a potential difference between the common electrode and individual electrodes 43.

The piezoelectric layer 42 is made of a piezoelectric material which is composed mainly of lead zirconium titanate which is a mixed crystal of lead titanate and lead zirconate, and arranged in a continuous manner on the upper surface of the vibration plate 41 so as to cover the plurality of chambers 10.

The plurality of individual electrodes 43, each of which has a planar shape of an approximately ellipse sufficiently smaller than each of the pressure chambers 10, are arranged on the upper surface of the piezoelectric layer 42 at the positions facing the approximately central portions of the pressure chambers 10, respectively. Further, the portions of the piezoelectric layer 42, which are sandwiched between the individual electrodes 43 and the vibration plate 41 which acts as the common electrode, are polarized downwardly in their thickness direction.

Further, the end portions of the individual electrodes 43 on the side opposite to the nozzles 15 with respect to the paper feeding direction, extend to positions which no longer face the pressure chambers 10; the leading ends thereof form connecting terminals 43*a* (not shown). The connecting terminals 43*a* are connected to a wiring member (not shown) such as a flexible printed circuit (FPC), etc., and further connected to a driver IC 45 (see FIG. 5) via the FPC. The driver IC 45, as will be described hereinbelow, applies one to three drive pulse(s) (see FIG. 7) to an individual electrode 43 according to the size of a dot to be formed so as to land an ink droplet on the recording paper P to form one dot. Namely, the driver IC 45 performs as a drive section which drives piezoelectric elements 46 as discharge energy applying sections as described below.

Then, in the piezoelectric actuator 32 of such a structure as described above, the portions facing the plurality of pressure chambers 10 (the portions encircled with the dashed-dotted lines in FIGS. 3 and 4) define piezoelectric elements 46 as discharge energy applying sections for applying pressures as discharge energies to the ink inside the pressure chambers 10, respectively. That is, the plurality of piezoelectric elements 46 are provided for the plurality of pressure chambers 10 (nozzles 15), respectively.

Here, a drive method for driving the piezoelectric actuator 32 (piezoelectric elements 46) will be explained. In the piezoelectric actuator 32, the individual electrodes 43 are maintained at the ground potential in advance. Then, when the potential of an individual electrode 43 becomes a predetermined drive potential V1 by applying a drive pulse to the individual electrode 43, a potential difference is generated between the individual electrode 43 and the vibration plate 41 which acts as the common electrode, thereby producing a downward electrical field in the same direction as the polarization direction in the piezoelectric layer 42 at the portion sandwiched by the electrodes. This electrical field causes the same portion in the piezoelectric layer 42 to contract in a horizontal direction perpendicular to its thickness direction, thereby deforming the portions, in the vibration plate 41 and the piezoelectric layer 42, which face a pressure chamber 10, as a whole, to project toward the side of the pressure chamber 10 and thus decrease the volume thereof. Consequently, the pressure on the ink inside the pressure chamber 10 increases, that is, as a discharge energy, a pressure is applied to the ink inside the pressure chamber 10, and thereby an ink droplet is discharged from a nozzle 15 which communicates with the pressure chamber 10. After that, as the potential of the individual electrode 43 returns to the ground potential, the piezoelectric actuator 32 also restores itself to the previous or afore-deformation state.

At this time, if one drive pulse is applied to the individual electrode 43 from the driver IC 45, the movement described above takes place only once, and only one ink droplet is discharged from the nozzle 15. Then, the one ink droplet is landed on the recording paper P to form one dot.

Further, if two drive pulses are successively applied to the individual electrode 43 from the driver IC 45, the movement described above takes place twice; thereby, two ink droplets are successively discharged from the nozzle 15. Then, the two ink droplets are landed on the recording paper P to form one dot.

Furthermore, if three drive pulses are successively applied to the individual electrode 43 from the driver IC 45, the movement described above takes place three times; thereby, three ink droplets are successively discharged from the nozzle 15. Then, the three ink droplets are landed on the recording paper P to form one dot.

Hereinafter, a dot formed by one ink droplet, a dot formed by two ink droplets and a dot formed by three ink droplets will be referred to as a small dot, a medium dot and a large dot, respectively. Further, in the embodiment, in order to form a medium dot and a large dot on a recording paper, a drive pulse is applied two and three times, respectively, to an individual electrode 43. This corresponds to an aspect of the present teaching that a drive pulse is applied multiple times to a piezoelectric element from drive section to form one dot on the printing medium.

Figure 5:
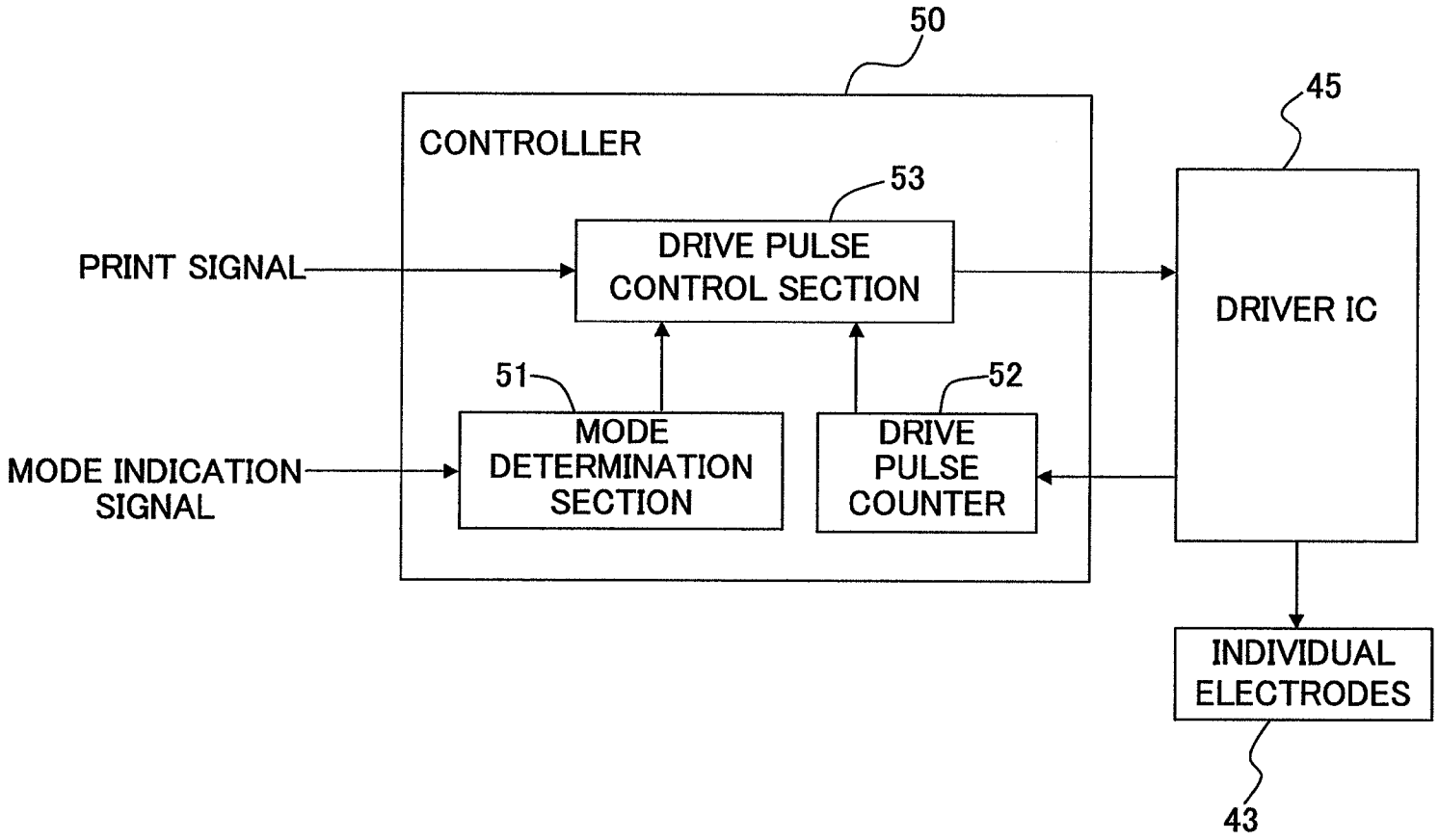
FIG. 5 is a block diagram of a controller of FIG. 1.

Next, as a control portion, a controller 50 which controls the operation of the printer 1 will be explained. The controller 50 is composed of a CPU (Central Processing Unit), a ROM (Read Only Memory), a RAM (Random Access Memory), etc. As shown in FIG. 5, these components operate as a mode determination portion 51, a drive pulse counter 52, a drive pulse control portion 53, etc., respectively.

The mode determination portion 51 determines an operation mode of the printer 1. More particularly, the printer 1 is capable of selectively operating in either of the following modes based on the information inputted from a user: a normal print mode in which it is possible to print an image having a high proportion of the large dots such as texts, graphs and the like at a comparatively high speed though the image quality is more or less degraded; and a high-resolution print mode in which it is possible to print an image having a high proportion of the small dots such as photographs and the like with a high image quality though the printing time is more or less long. Thus, the mode determination portion 51 determines the printer 1 to operate in either of the normal print mode and the high-resolution print mode, according to a mode indication signal which is inputted by the user to select the mode.

The drive pulse counter 52 individually counts the number of times of applying a drive pulse each time to the individual electrode 43 of each piezoelectric element 46 from the driver IC 45, and stores an integrated value Cs, as a parameter with respect to the usage amount, of the number of times of applying the drive pulse to each individual electrode 43 up to the present. In other words, the drive pulse counter 52 functions as a storage section which updates and stores the parameter. As will be described hereinbelow, the drive pulse control portion 53 controls the number of drive pulses to be applied to the individual electrode 43 from the driver IC 45, according to a print signal which is inputted from outside and indicates the size of a ink droplet to be landed on the recording paper P, the print mode determined by the mode determination portion 51, and the integrated value Cs stored in the drive pulse counter 52.

Next, a printing process carried out by the printer 1 will be explained. Here, the controller 50 actuates the ink-jet heads 2 (the piezoelectric elements 46), transport rollers 3, etc., to carry out the following operation.

Normally, the printer 1 stands by until a print signal is inputted from outside (S101: NO). When a print signal is inputted and printing is started and carried out in a high-resolution print mode (S102: YES), a certain number of drive pulse(s) according to the print signal are/is applied to an individual electrode 43 from the driver IC 45. That is, when the print signal indicates a large dot, a medium dot, or a small dot to be landed on the recording paper P, three, two, or one of the drive pulse(s) are/is applied accordingly, as shown in FIG. 7A, to the individual electrode 43 from the driver IC 45 (S103).

On the other hand, when printing is started and carried out in the normal print mode (S102: NO), it is determined whether a predetermined value Cp, as a predetermined threshold value, is exceeded by an integrated value Cs which is stored in the drive pulse counter 52 and which corresponds to the piezoelectric element 46 to be driven (S104).

Then, if the predetermined value Cp is exceeded by the integrated value Cs which corresponds to the piezoelectric element 46 to be driven (S104: YES), after that, the number of drive pulses applied to the individual electrode 43 of the corresponding piezoelectric element 46 from the driver IC 45, is reduced (lessened) to be less than usual (previous).

Figure 7A:
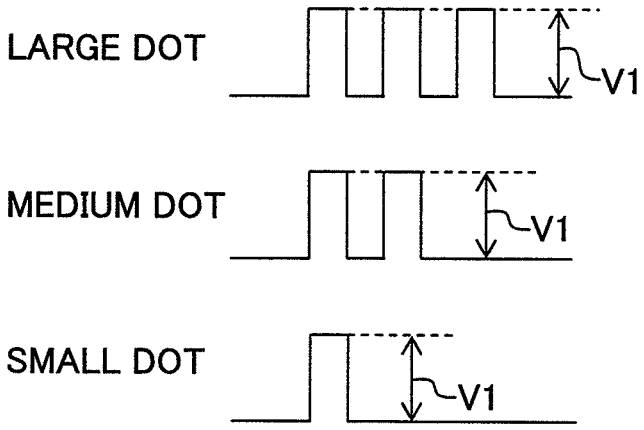
FIG. 7A is a diagram showing a drive pulse(s) applied to an individual electrode from a driver IC as usual (under normal conditions)
Figure 7B:
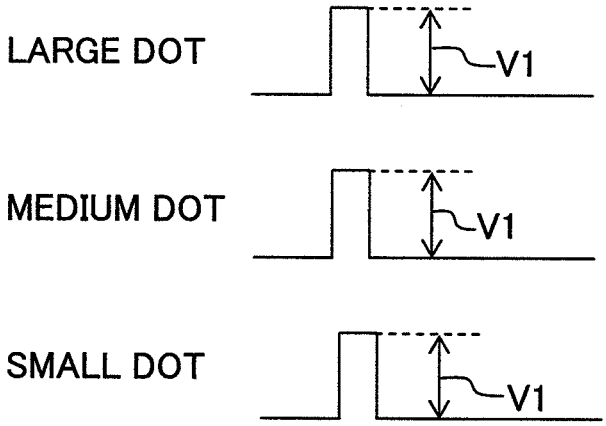
FIG. 7B is a diagram showing a drive pulse applied to an individual electrode from a driver IC when a predetermined value is exceeded by an integrated value of the number of times of applying the drive pulse.

In particular, as shown in FIGS. 7A and 7B, when the print signal indicates a large dot to be landed on the recording paper P, the number of drive pulses applied to the individual electrode 43 from the driver IC 45 is reduced from three to one; when the print signal indicates a medium dot to be landed on the recording paper P, the number of drive pulses applied to the individual electrode 43 from the driver IC 45 is reduced from two to one. Thereby, the discharge energy applied to the ink inside the pressure chamber 10 from the piezoelectric element 46 becomes lower than previous. In addition, when the print signal indicates a small dot to be landed on the recording paper P, the number of drive pulse applied to the individual electrode 43 from the driver IC 45 remains at one.

Here, in a piezoelectric element 46 of the piezoelectric actuator 32, as the total number of times of driving, that is, the usage amount, becomes greater, namely, as the total discharge energy applied to the ink inside the pressure chamber 10 from the piezoelectric element 46 becomes higher, the polarization of the piezoelectric layer 42 weakens, etc., and thereby the drive performance of the piezoelectric element 46 degrades. Therefore, if the drive pulse height (drive potential) stays constant, the maximum drivable number of times Cm is predetermined such that the piezoelectric element 46 can maintain a predetermined drive performance. Hence, if the total number of times of driving the piezoelectric element 46, that is, the integrated value Cs, reaches the maximum drivable number of times Cm, then the piezoelectric element 46 can no longer maintain the predetermined drive performance. Hence, if the usage amount of a particular piezoelectric element 46 is great, then the piezoelectric element 46 having the great usage amount may no longer maintain the predetermined drive performance at an early stage. Consequently, even if the other piezoelectric elements 46 still maintain a predetermined drive performance, the printer 1 will inevitably become unable to print. Further, suppose the number of times of driving be the same, the drive performance is easier to degrade for a piezoelectric element 46 driven on a high drive voltage than a piezoelectric element 46 driven on a low drive voltage. Therefore, the maximum drivable number of times Cm for a piezoelectric element 46 may be determined dependending on its drive voltage.

At this time, it would be possible for the printer 1 to continue to print if a so-called serial head were employed. In such an ink-jet head which is different from that in the embodiment and which discharges inks from nozzles while moving in the scanning direction, another nozzle can discharge the ink instead of the nozzle which corresponds to the un-drivable piezoelectric element. However, since the ink-jet heads 2 in the embodiment are line heads, it is difficult to carry out such kind of control.

To address this problem, in the embodiment, when a predetermined value Cp is exceeded by the number of times of driving the piezoelectric element 46, that is, the integrated value Cs of the number of times of applying a drive pulse to the individual electrode 43 from the driver IC 45, after that, the number of drive pulses applied to the individual electrode 43 of the corresponding piezoelectric element 46, is reduced to be less than usual. Further, the predetermined value Cp is a value smaller than the maximum drivable number of times Cm for the piezoelectric element 46, for example, about 80% to about 90% of the maximum drivable number of times Cm.

With this, since a small dot is landed on the area where a medium dot or a large dot should have been landed on the recording paper P, there are more or less effects on image quality of the printed image. However, since the number of times of applying the drive pulse to the individual electrode 43 of the corresponding piezoelectric element 46, becomes less in printing, the number of times of driving the piezoelectric element 46 decreases. Namely, the discharge energy applied to the ink inside the pressure chamber 10 from the piezoelectric element 46 becomes lower. This makes it possible to prolong the life of the corresponding piezoelectric element 46.

The piezoelectric actuator 32 applies a pressure to the ink inside a pressure chamber 10 by being applied a drive pulse to an individual electrode 43. Therefore, it is possible to easily lower the discharge energy applied to the piezoelectric element 46 by reducing the number of drive pulses applied to the individual electrode 43 from the driver IC 45.

On the other hand, when the predetermined value Cp is not exceeded by the integrated value Cs which corresponds to the piezoelectric element 46 (S104: NO), it is a further determined (S105) whether a predetermined rate Rp is reached or exceeded by a rate R of the piezoelectric elements 46 of which the integrated value Cs exceeds the predetermined value Cp in any of the four ink-jet heads 2 (one ink-jet head 2 including the piezoelectric element 46 to be driven, and the other three ink-jet heads 2).

Then, when the predetermined rate Rp is not reached nor exceeded by the rate R of the piezoelectric elements 46 of which the integrated value Cs exceeds the predetermined value Cp in any of the four ink-jet heads 2 (S105: NO), in the same manner as above, a certain number of drive pulse(s) according to the print signal are/is applied to the individual electrode 43 from the driver IC 45 (S103).

On the other hand, when the predetermined rate Rp is reached or exceeded by the rate R of the piezoelectric elements 46 of which the integrated value Cs exceeds the predetermined value Cp in any of the four ink-jet heads 2 (S105: YES), even if the predetermined value Cp is not exceeded by the integrated value Cs which corresponds to the piezoelectric element 46 to be driven, after that, the number of drive pulses applied to the individual electrode 43 from the driver IC 45, is reduced to be less than previous (S106), that is, the discharge energy applied to the ink inside the pressure chamber 10 is lowered.

Here, even if the predetermined value Cp is not exceeded by the integrated value Cs which corresponds to the piezoelectric element 46 to be driven, in the ink-jet head 2 which includes the corresponding piezoelectric element 46, a high rate R of the piezoelectric elements 46 of which the integrated value Cs exceeds the predetermined value Cp, may result in the following possible consequence: when drive pulse(s) are/is applied as usual to the individual electrode 43 of the corresponding piezoelectric element 46, in the printed image, a great difference in image quality may occur between the portions formed by the landed ink droplet(s) discharged from the nozzles 15 which correspond to the piezoelectric elements 46 to which the number of drive pulses applied is reduced, and the portions formed by the landed ink droplet(s) discharged from the nozzles 15 which correspond to the piezoelectric elements 46 to which a usual number of drive pulses is applied.

Further, in any of the four ink-jet heads 2, a high rate R of the piezoelectric elements 46 of which the integrated value Cs exceeds the predetermined value Cp, may cause dot sizes to vary greatly among the different colors, if drive pulses are applied as usual to the individual electrodes 43 of the piezoelectric elements 46 which are included in the other ink-jet heads 2. This may greatly degrades the quality of the printed image.

Nevertheless, in the embodiment, in any of the four ink-jet heads 2, when the predetermined rate Rp is reached or exceeded by the rate R of the piezoelectric elements 46 of which the integrated value Cs exceeds the predetermined value Cp, even if the predetermined value Cp is not exceeded by the integrated value Cs which corresponds to the piezoelectric element 46 to be driven, the number of drive pulses applied to the individual electrode 43 of the corresponding piezoelectric element 46, is reduced. Therefore, in the ink-jet head 2 which includes the piezoelectric element 46 to be driven, a high rate R of the piezoelectric elements 46 of which the integrated value Cs exceeds the predetermined value Cp, degrades the entire image quality of the printed image. Therefore, it is possible to prevent a great difference in image quality from occurring between different portions in the printed image.

Further, in any of the four ink-jet heads 2, when the rate R of the piezoelectric elements 46 of which the integrated value Cs exceeds the predetermined value Cp, has become higher, regardless of the color of ink to be discharged from the nozzle 15 which corresponds to the piezoelectric element 46 to be driven, the number of drive pulses applied to the individual electrode 43 of the piezoelectric element 46, is reduced. This regulates the variation in dot size among the different colors, and is thereby able to prevent great degradation in image quality.

Further, when printing is started and carried out in the high-resolution print mode described above (S102: YES), if the number of drive pulses applied to the individual electrode 43 from the driver IC 45 is reduced, differently from the embodiment, the quality of the printed image, in particular, degrades conspicuously.

However, in the embodiment, when printing is started and carried out in the high-resolution print mode, regardless of the integrated value Cs which corresponds to the piezoelectric element 46 to be driven, the number of drive pulses applied to the individual electrode 43 is not reduced but applied as usual. Accordingly, it is possible to prevent the printed image from degrading in image quality.

Further, when printing is carried out in high-resolution, since small dots are used more than medium and large dots, there is a low frequency of applying two or three drive pulses to the individual electrode 43 to form one dot. Accordingly, even if the number of drive pulses applied to the individual electrode 43 is not reduced, the life of the piezoelectric element 46 will not be greatly shortened.

On the other hand, when printing is started and carried out in the normal print mode, as described above, even if the number of drive pulses applied to the individual electrode 43 from the driver IC 45 is reduced, degradation in image quality of the printed image is not as conspicuous as degradation when the printing is started and carried out in the high-resolution print mode.

Next, a few modifications which apply various changes to the embodiment will be explained. Note that, the constitutive parts or components, which are the same as or equivalent to those of the embodiment described above, are designated by the same reference numerals, any explanation of which will be omitted as appropriate.

Figure 8A:
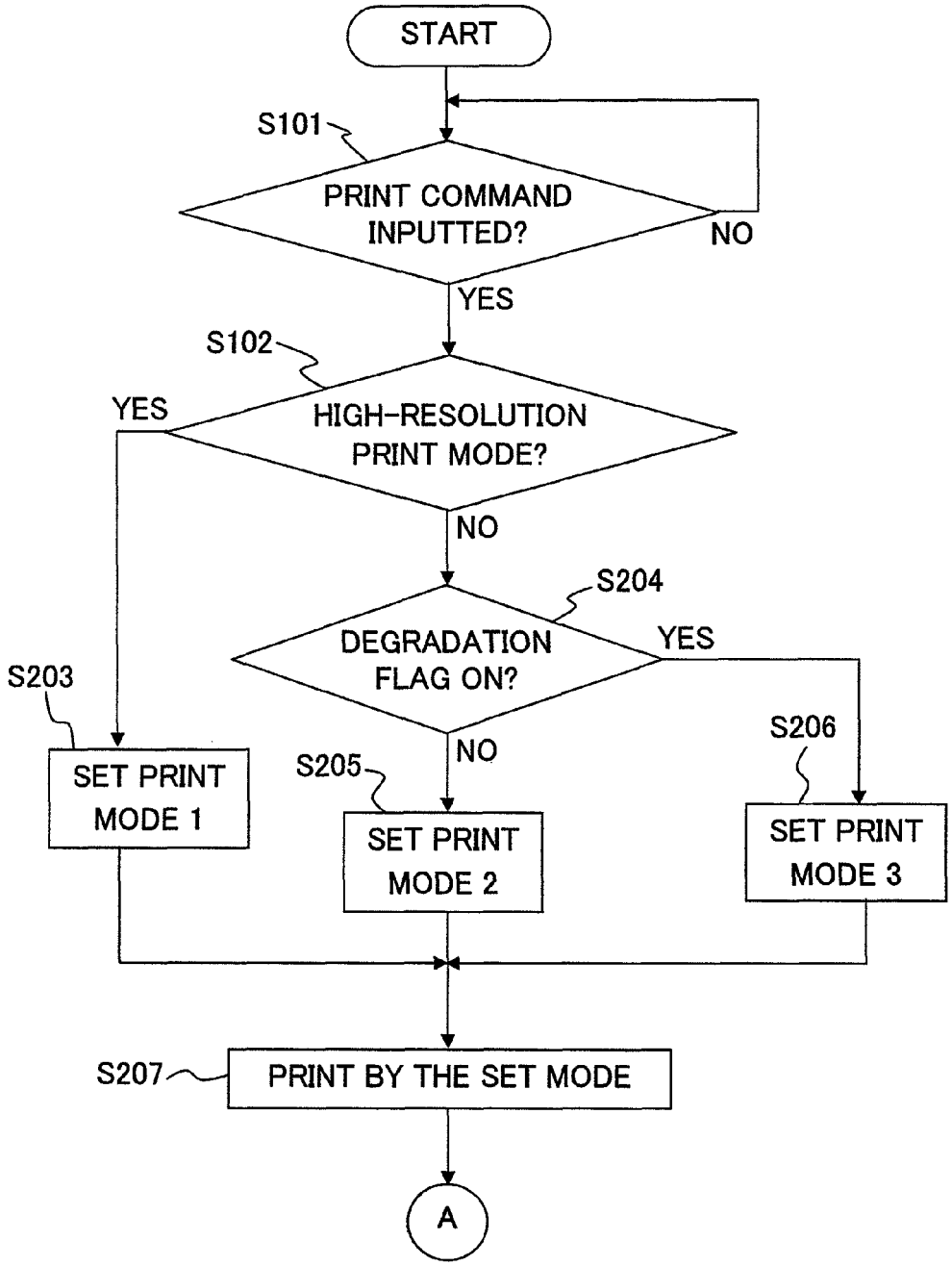
FIGS. 8A and 8B show a flow chart of Modification 1, corresponding to FIG. 6.
Figure 8B:
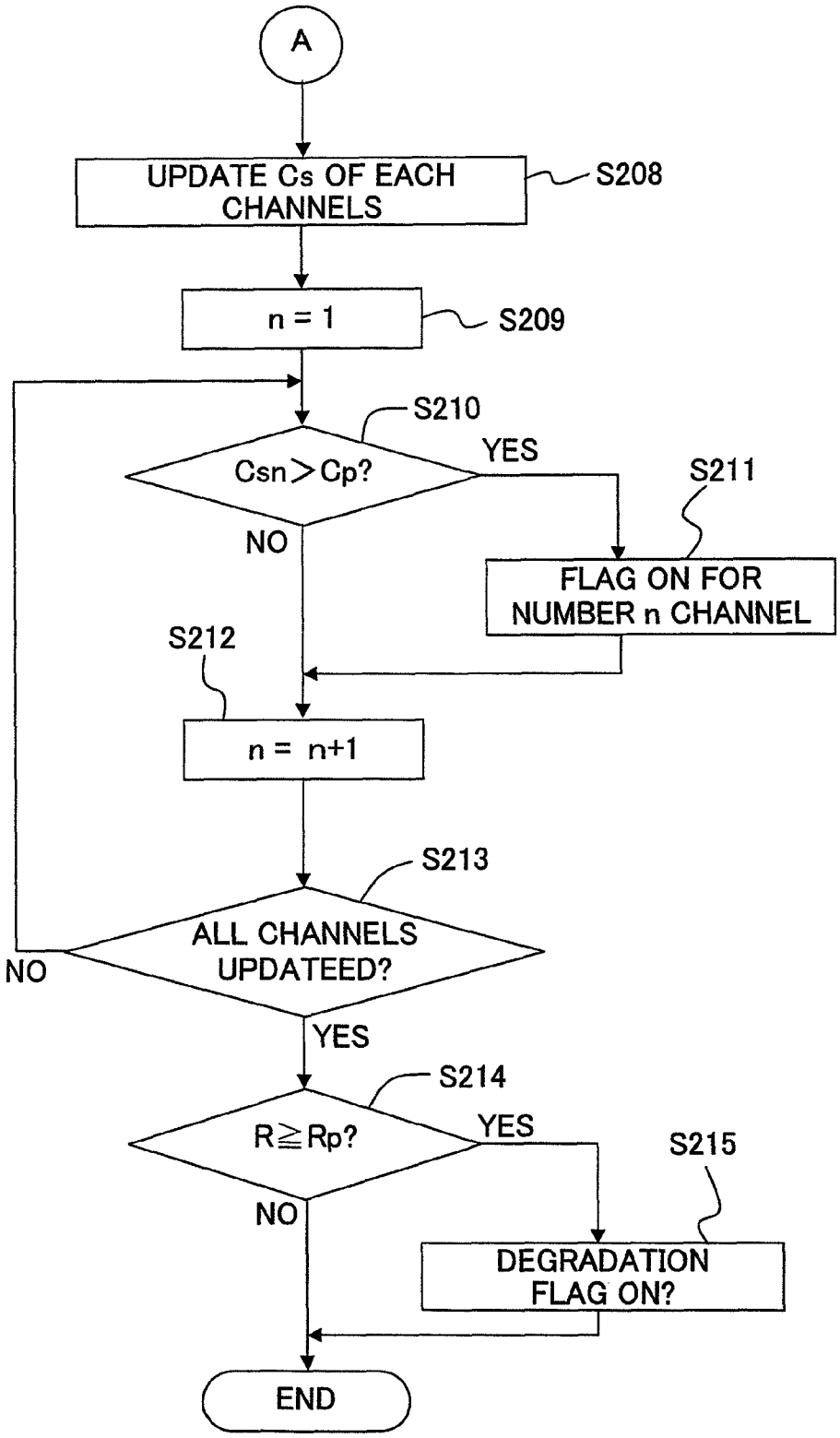

In one modification (Modification 1), as shown in FIG. 8, when a print command is inputted (S101: YES) and the printing is performed in the high-resolution print mode (S102: YES), print mode 1 is set (S203). In the print mode 1, the printing is performed by applying drive pulse(s) as usual. When the printing is not performed in the high-resolution print mode (S102: NO), with respect to an ink-jet head 2 including the piezoelectric element 46 to be driven, a determination whether a degradation flag, which will be described later, is on or not is made (S204). When the degradation flag is not on (S204: NO), print mode 2 is set (S205). In the print mode 2, the number of pulses which will be applied to the piezoelectric element 46 of which flag "1" is on is reduced. The meaning of flag "1" will be described later. When the degradation flag is on (S204: YES), print mode 3 is set (S206). In the print mode 3, the number of pulses which will be applied to each of the piezoelectric elements 46 included in the ink-jet head 2 is reduced. The printing is performed in the set print mode (S207), and then, the integrated value Cs of each of the piezoelectric elements 46 is updated (S208). After that, for each of the piezoelectric elements 46, a determination whether the integrated value Csn exceeds the predetermined value Cp or not is made, and when the integrated value Csn exceeds the predetermined value Cp, the flag "1" is set on with respect to the piezoelectric element 46 (S209-S213). After the flag is updated for each of the piezoelectric elements 46 (S213: YES), it is determined whether a rate R of the piezoelectric element 46 of which integrated value Cs exceeds the predetermined value Cp among the piezoelectric elements 46 in the ink-jet heads 2 is not less than a predetermined rate Rp (S214). When the rate R of the piezoelectric element 46 of which integrated value Cs exceeds the predetermined value Cp among the piezoelectric elements 46 in the ink-jet heads 2 is not less than the predetermined rate Rp, the degradation flag is set on with respect to the ink-jet head 2 (S215). Namely, the degradation flag means that the rate R of the piezoelectric element 46 of which integrated value Cs exceeds the predetermined value Cp among the piezoelectric elements 46 in the ink-jet heads 2 is not less than the predetermined rate Rp.

In this case, in the ink-jet head 2 which includes the piezoelectric element 46 to be driven, when the predetermined value Rp is not less than the rate R of the piezoelectric elements 46 of which integrated value Cs exceeds the predetermined value Cp, even if the predetermined value Cp is not exceeded by the integrated value Cs which corresponds to the piezoelectric element 46 to be driven, the number of drive pulses applied to the individual electrode 43 of the corresponding piezoelectric element 46, is reduced. Accordingly, in the same manner as the embodiment described above, it is possible to prevent a great difference from occurring in image quality among different portions of the printed image.

In Modification 1, the number of drive pulses applied to the individual electrode is controlled based on the rate R of the piezoelectric elements 46, of which the integrated value Cs exceeds the predetermined value Cp, in the ink-jet head 2 which includes the piezoelectric element 46 to be driven. However, the control as described above may also be carried out for each row of nozzles included in one ink-jet head 2, in other words, for each row of the piezoelectric elements 46. For example, in a row of the piezoelectric elements 46 including the piezoelectric element 46 to be driven, when the predetermined rate Rp is reached or exceeded by the rate R of the piezoelectric element 46 of which the integrated value Cs exceeds the predetermined value Cp, even if the predetermined value Cp is not exceeded by the integrated value Cs of the corresponding piezoelectric element 46, the control may also be carried out to reduce the number of drive pulses applied to the individual electrode 43 of the corresponding piezoelectric element 46. By such a control, it is possible to prevent a great difference from occurring in image quality among different portions of the printed image.

Alternatively, in a row of the piezoelectric elements 46 including the piezoelectric element 46 to be driven, when the predetermined value Cp is exceeded by the integrated value Cs of a piezoelectric element 46 adjacent to the piezoelectric element 46 to be driven, even if the predetermined value Cp is not exceeded by the integrated value Cs of the corresponding piezoelectric element 46 to be driven, the control may also be carried out to reduce the number of drive pulses applied to the individual electrode 43 of the corresponding piezoelectric element 46 to be driven. By such a control, it is possible to prevent a great difference from occurring in image quality among different portions of the printed image.

Figure 6:
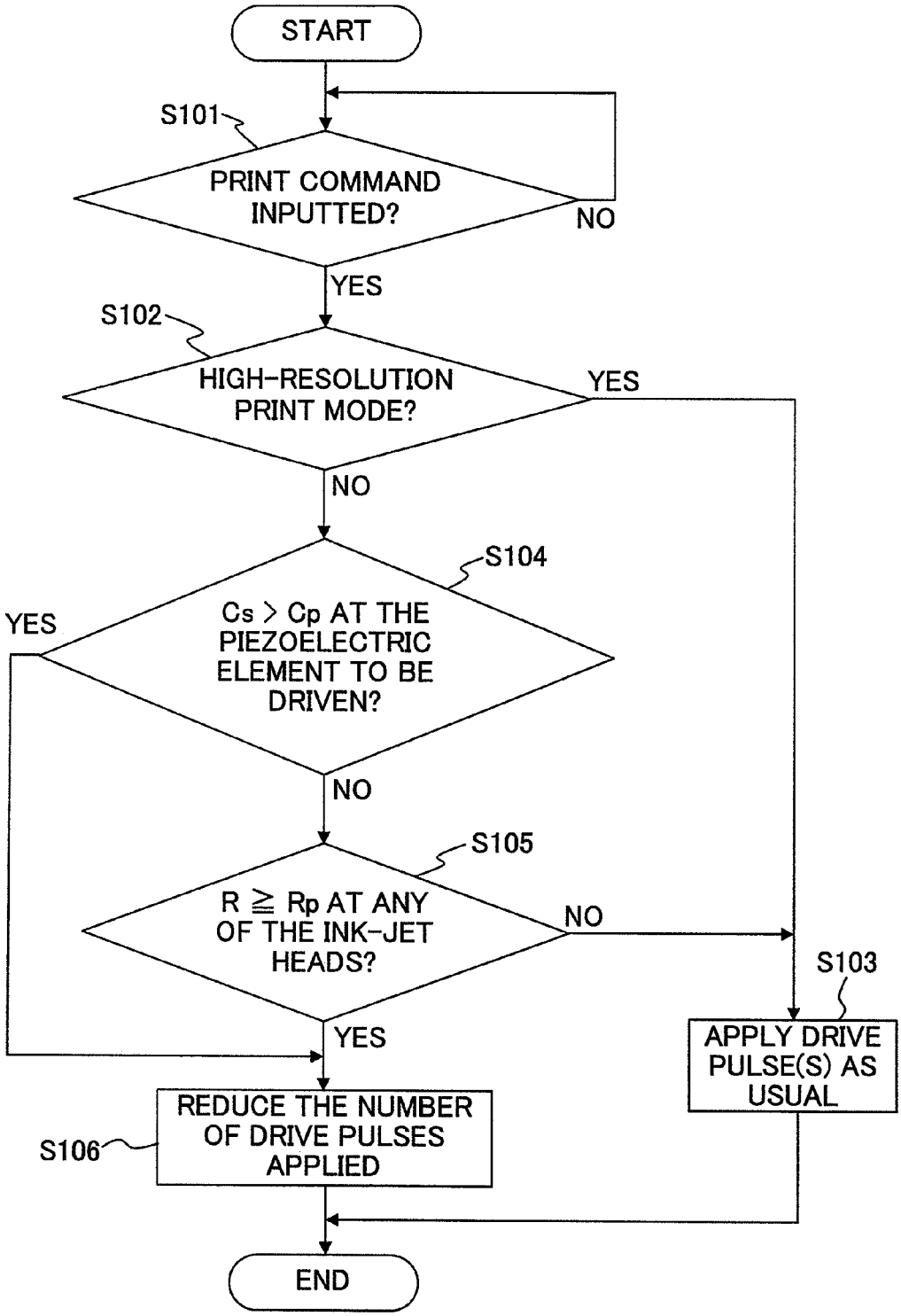
FIG. 6 is a flow chart showing a control flow of the controller when a printer 1 carries out printing.
Figure 9:
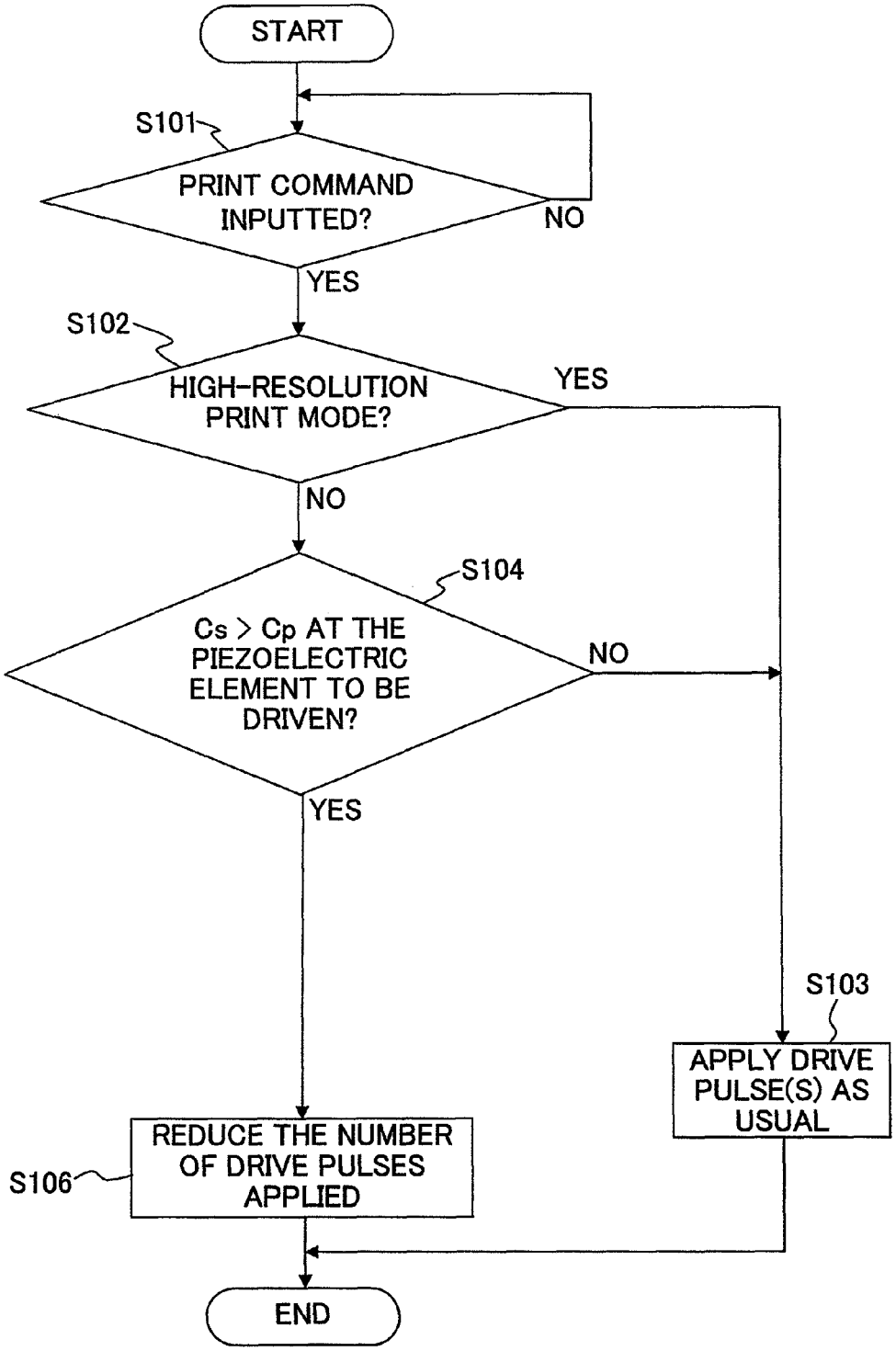
FIG. 9 is a flow chart of Modification 2, corresponding to FIG. 6.

Further, in another modification (Modification 2), as shown in FIG. 9, when the predetermined value Cp is not exceeded by the integrated value Cs which corresponds to the piezoelectric element 46 to be driven (S104: NO), the determination as shown above in S105 and 5214 (see FIGS. 6 and 8) is not made, and drive pulses are applied as usual (S103).

Even in this case, if the predetermined value Cp is exceeded by the integrated value Cs which corresponds to the piezoelectric element 46 to be driven, after that, the number of drive pulses applied to the individual electrode 43 of the corresponding piezoelectric element 46 is reduced to be less than usual; thus a small dot is landed to the area where a medium dot or a large dot should have been landed on the recording paper P. Therefore, although there are more or less effects on image quality of the printed image, it is possible to prolong the life of the corresponding piezoelectric element 46 because the number of drive pulses applied to the individual electrode 43 of the corresponding piezoelectric element 46 becomes less in printing.

Further, in the embodiment described above, when the predetermined value Cp is exceeded by the number of times of applying the drive pulse to the individual electrode 43 of the piezoelectric element 46, after that, even if the print signal indicates either a large dot or a medium dot to be landed, the number of drive pulses applied to the individual electrode 43 from the driver IC 45 is reduced to one. However, it is not limited to this manner to reduce the number of drive pulses.

Figure 10A:
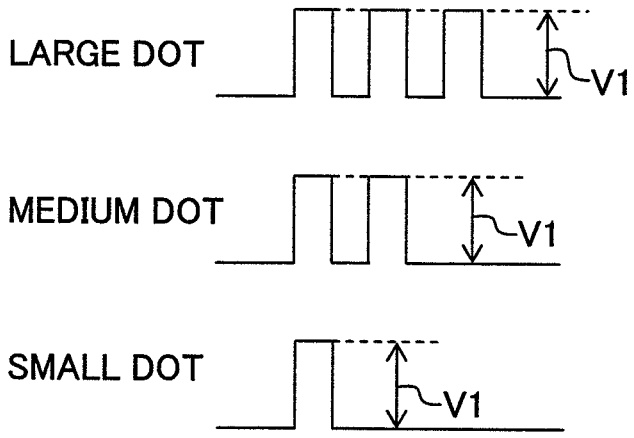
FIG. 10A is a diagram of Modification 3, corresponding to FIG. 7A.
Figure 10B:
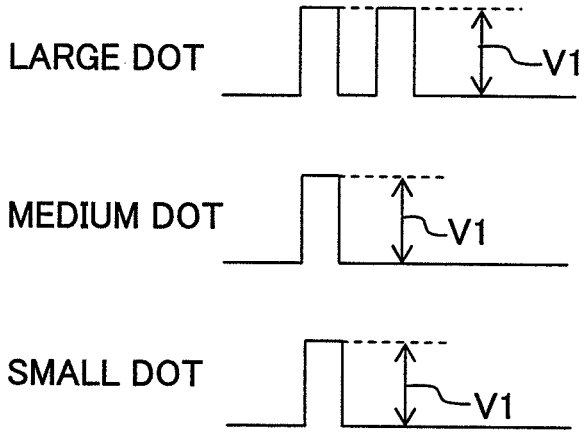
FIG. 10B is a diagram of Modification 3, corresponding to FIG. 7B.

In yet another modification (Modification 3), when the predetermined value Cp is exceeded by the number of times of applying the drive pulse to the individual electrode 43 of the piezoelectric element 46, after that, as shown in FIGS. 10A and 10B, if the print signal indicates a large dot to be landed, the number of drive pulses applied to the individual electrode 43 from the driver IC 45 is reduced from three to two; if the print signal indicates a medium dot to be landed, the number of drive pulses applied to the individual electrode 43 from the driver IC 45 is reduced from two to one. Further, in this case, in the same manner as the embodiment described above, if the print signal indicates a small dot to be landed, the number of drive pulse applied to the individual electrode 43 from the driver IC 45 also remains at one.

Even in this case, if the predetermined value Cp is exceeded by the integrated value Cs which corresponds to the piezoelectric element 46 to be driven, after that, the number of drive pulses applied to the individual electrode 43 of the corresponding piezoelectric element 46 is reduced to be less than usual; thus a small dot and a medium dot are landed to the areas where a medium and a large dot should have been landed on the recording paper P, respectively. Therefore, although there are more or less effects on image quality of the printed image, since the number of drive pulses applied to the individual electrode 43 of the corresponding piezoelectric element 46 becomes less in printing, the number of times of driving the piezoelectric element 46 decreases; thereby the life of the corresponding piezoelectric element 46 extends.

Further, in the embodiment described above, when the predetermined value Cp is exceeded by the number of times of applying the drive pulse to the individual electrode 43 of the piezoelectric element 46, after that, the number of drive pulses applied to the individual electrode 43 from the driver IC 45 is reduced. However, there is no limitation to this.

Figure 11A:
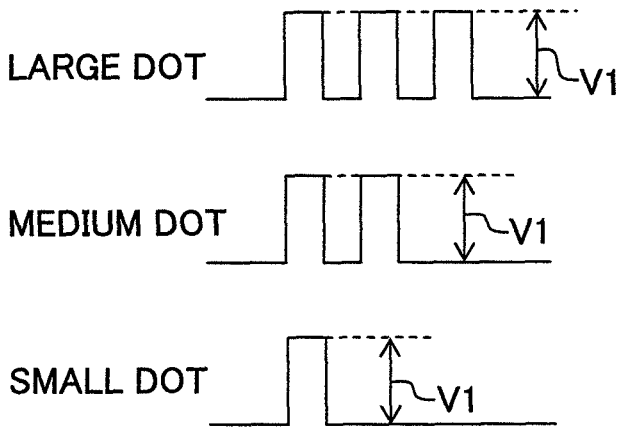
FIG. 11A is a diagram of Modification 4, corresponding to FIG. 7A.
Figure 11B:
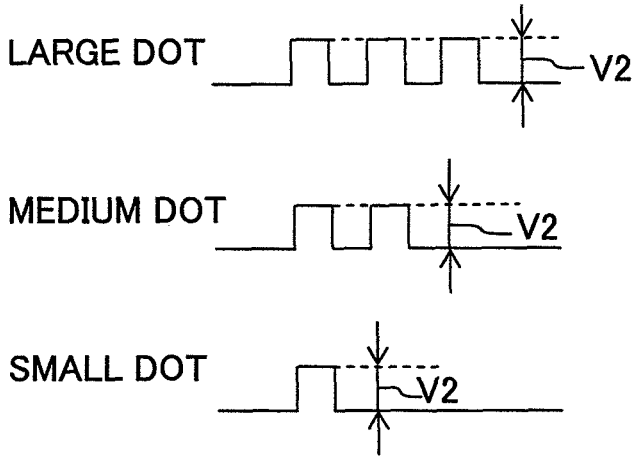
FIG. 11B is a diagram of Modification 4, corresponding to FIG. 7B.

In yet another modification (Modification 4), in a case such as the integrated value Cs described above exceeds the predetermined value Cp, as shown in FIGS. 11A and 11B, the drive pulse control portion 53 does not change the number of times of applying the drive pulse to the individual electrode 43 from the driver IC 45, but lowers the height thereof to be lower than usual (to be a height at which the drive potential becomes a drive potential V2 which is lower than the usual drive potential V1).

Here, when the height of drive pulses stays constant, the maximum drivable number of times Cm is predetermined for the piezoelectric element 46. However, if the height of drive pulses is lowered to be a lower drive potential, the discharge energy applied to the ink inside the pressure chamber 10 from the piezoelectric element 46 also becomes lower. Thus, when the piezoelectric element 46 is driven, the maximum drivable number of times Cm increases. Therefore, when the predetermined value Cp is exceeded by the number of times of applying the drive pulse to the individual electrode 43 of the piezoelectric element 46, after that, by lowering the height of drive pulses applied to the individual electrode 43 from the driver IC 45, it is possible to prolong the life of the piezoelectric element 46.

Further, in this case, because the piezoelectric actuator 32 applies a pressure to the ink inside the pressure chamber 10 by applying drive pulse(s) to the individual electrode 43, it is possible to easily lower a discharge energy applied to the piezoelectric element 46 by lowering the height of drive pulses.

Further, in the embodiment described above, when printing is started and carried out in the high-resolution print mode, regardless of the integrated value Cs which corresponds to the piezoelectric element 46 to be driven, the number of drive pulses applied to the individual electrode 43 is not reduced. However, even if printing is started and carried out in the high-resolution print mode, the number of drive pulses may also be reduced in the same manner as printing is started and carried out in the normal print mode.

In the embodiment described above, the predetermined value Cp, of the number of times of applying the drive pulse, is set in one phase. However, it may be set in two or more phases. For example, when the predetermined value, of the number of times of applying the drive pulse, is set in two phases to Cp1 and Cp2 (Cp1<Cp2), if Cp2 is not exceeded by the integrated value Cs of the number of times of driving any of the piezoelectric elements 46, in the same manner as the embodiment described above, printing may be carried out in the high-solution print mode without reducing the number of drive pulses applied to the individual electrode 43; if Cp2 is exceeded by the integrated value Cs of the number of times of driving any of the piezoelectric elements 46, even in the high-solution print mode, the number of drive pulses may also be reduced in the same manner as in the normal print mode.

Further, in the embodiment described above, the printer 1 has four ink-jet heads 2 which discharge inks of different colors from each other; however, the number of the ink-jet head 2, and the kind and number of the color of ink discharged from the ink-jet head 2 are not limited thereto.

Further, in the embodiment described above, the ink-jet head 2 is a so-called line head; however, it is not limited thereto but may also be a so-called serial head which discharges ink from a nozzle while reciprocating in a scanning direction.

Further, the above description has given an example of applying the present teaching to a printer which has an ink-jet head discharging an ink droplet from the nozzle 15 by applying a pressure to the ink inside the pressure chamber 10 through the piezoelectric element 46; however, different in method therefrom and not limited thereto, it is also possible to apply the present teaching to a printer which has an ink-jet head applying a discharge energy for discharging an ink from a nozzle.

As an example, if the ink-jet head is such a one that discharges an ink droplet from a nozzle through raising the pressure on the ink inside a pressure chamber (applying a discharge energy) by heating the pressure chamber with a heater and thereby inflating the air bubbles inside the pressure chamber, as a total length of time of heating with the heater becomes longer, the heater gets more degraded in thermal capability due to the effect of burnt deposits and the like produced on the heater surface.

In view of such a case, suppose a timer or the like be provided in the controller instead of the above-described drive pulse counter 52, for example, to measure the heating time of the heater and store an integrated value thereof at the same time. When the integrated value exceeds a predetermined value, after that, the time length of heating the pressure chamber with the heater is shortened to be shorter than previous to form one dot. Accordingly, the discharge energy applied to the ink inside the pressure chamber from the heater becomes lower, thereby restraining the heater from degrading in thermal capability and making it possible to prolong the life of the ink-jet head.

Nevertheless, in this case, because the time of heating the pressure chamber with the heater is shortened, the inflation amount of the air bubbles decreases and thereby the ink droplet discharged from the nozzle become smaller in volume. Therefore, the printed image degrades more or less in image quality.

Further, with respect to the piezoelectric element 46 in the embodiment described above, it is understood that as the driving time becomes longer, the integrated value Cs of the number of times of applying the drive pulse to the individual electrode 43 from the driver IC 45 increases. Therefore, in the embodiment described above, a timer as described above may also be provided instead of the drive pulse counter 52. When a predetermined value is exceeded by an integrated value, stored in the timer, of the time of driving the piezoelectric element 46, after that, the number of drive pulses applied to the individual electrode 43 from the driver IC 45 may, for example, be reduced to be less than usual.

Furthermore, the above description has given an example of applying the present teaching to an ink-jet printer which prints an image by discharging an ink from a nozzle; however, not limited thereto, it is possible to apply the present teaching to a printing apparatus which has a liquid discharge head for discharging a liquid other than ink, such as printing apparatuses for printing a wiring pattern by discharging a liquid droplet of a conductive material from a nozzle to form a wiring.

What is claimed is:

1. A printing apparatus which performs printing by discharging a liquid onto a printing medium, the printing apparatus comprising:

a liquid discharge head which includes:

a nozzle which discharges the liquid to the printing medium; and a discharge energy applying section which applies a discharge energy to the liquid to be discharged from the nozzle;

a drive section which drives the discharge energy applying section; and a controller which controls the drive section based on a parameter with respect to a total number of times of driving of the discharge energy applying section;

wherein, when one dot is formed on the printing medium by discharging the liquid from the nozzle, if a predetermined threshold value is not exceeded by the parameter, the controller controls the drive section to drive the discharge energy applying section so that a first discharge energy is applied to the liquid, and if the predetermined threshold value is exceeded by the parameter, the controller controls the drive section to drive the discharge energy applying section so that a second discharge energy which is lower than the first discharge energy is applied to the liquid;

wherein the predetermined threshold value is based on a maximum drivable number of times of the discharge energy applying section;

wherein the printing apparatus is selectively operable in one of a normal print mode to perform the printing with a predetermined resolution and a high-resolution print mode to perform the printing with a resolution higher than the predetermined resolution in the normal print mode; and wherein when the printing apparatus operates in the high-resolution print mode, the controller controls the device section to drive the discharge energy applying section, so that the first discharge energy which is higher than the second discharge energy is applied to the liquid, regardless of whether the predetermined threshold value is exceeded by the parameter or not.

2. The printing apparatus according to claim 1;

wherein the controller includes a storage section which updates and stores the parameter each time the discharge energy applying section is utilized.

3. The printing apparatus according to claim 1;

wherein the liquid discharge head further includes a pressure chamber which communicates with the nozzle;

wherein the discharge energy applying section is a piezoelectric element which applies the discharge energy to the liquid in the pressure chamber by applying a pressure to the liquid;

wherein the drive section drives the piezoelectric element by applying a drive pulse to the piezoelectric element; and wherein the parameter is a number of times of applying the drive pulse to the piezoelectric element.

4. The printing apparatus according to claim 3;

wherein the, controller further includes a drive pulse counter which counts the number of times of applying the drive pulse to the piezoelectric element.

5. The printing apparatus according to claim 3;

wherein if the threshold value is not exceeded by the parameter, the controller controls the drive section so that the drive pulse is applied to the piezoelectric element by a predetermined number of times, and the liquid is discharged from the nozzle to form one dot on the printing medium; and wherein if the threshold value is exceeded by the parameter, the controller controls the drive section so that the drive pulse is applied to the piezoelectric element by a number of times less than the predetermined number of times, and the liquid is discharged from the nozzle to form one dot on the printing medium.

6. The printing apparatus according to claim 5;

wherein the controller includes a drive pulse controller which controls the number of times of applying the drive pulse to the piezoelectric element from the drive section upon forming the one dot.

7. The printing apparatus according to claim 3;

wherein if the threshold value is not exceeded by the parameter, the controller controls the drive section so that a first drive pulse is applied to the piezoelectric element, and the liquid is discharged from the nozzle to form one dot on the printing medium; and wherein if the threshold value is exceeded by the parameter, the controller controls the drive section so that a second drive pulse, which is lower in height than the first drive pulse, is applied to the piezoelectric element and the liquid is discharged from the nozzle to form one dot on the printing medium.

8. The printing apparatus according to claim 7;

wherein the controller includes a drive pulse controller which controls the drive section to change the drive pulse, to be applied from the drive section to the piezoelectric element, between the first drive pulse and the second drive pulse.

9. The printing apparatus according to claim 1;

wherein the nozzle is formed in the liquid discharge head as a plurality of nozzles, and the discharge energy applying section is provided as a plurality of discharge energy applying sections which correspond to the plurality of nozzles, respectively; and wherein, when a rate of a discharge energy applying section, of which parameter exceeds the predetermined threshold, among the plurality of discharge energy applying sections is not less than a predetermined, rate, the controller controls the drive section to drive a discharge energy applying section of which parameter does not exceed the threshold value so that the second discharge energy is applied to the liquid, even upon forming one dot on the printing medium by discharging the liquid from a nozzle which corresponds to the discharge energy applying section of which parameter does not exceed the threshold value.

10. The printing apparatus according to claim 9;

wherein the liquid discharge head extends in a predetermined direction and is fixed to the printing apparatus, and the nozzles are aligned in the predetermined direction.

11. The printing apparatus according to claim 9;

wherein the liquid discharge head is provided as a plurality of liquid discharge heads which discharge different color inks as the liquid, respectively; and wherein, when a rate of a discharge energy applying section, of which parameter exceeds the predetermined threshold, among the plurality of discharge energy applying sections is not less than a predetermined rate, in any of the liquid discharge heads, the controller controls the drive section to drive a discharge energy applying section of which parameter does not exceed the threshold value so that the second discharge energy is applied to the ink, regardless of a color of the color ink which is to be discharged, even upon forming one dot on the printing medium by discharging the ink from a nozzle which corresponds to the discharge energy applying section of which parameter does not exceed the threshold value.

* * * * *